US006057764A

United States Patent [19]

Williams

[11] Patent Number: 6,057,764

[45] Date of Patent: May 2, 2000

[54] DYNAMICALLY BYPASSED ALARM SYSTEM

[76] Inventor: Melvin P. Williams, 85 Butternut Rd., Manchester, Conn. 06040

[21] Appl. No.: 09/136,278

[22] Filed: Aug. 20, 1998

[51] Int. Cl.[7] ..... G08B 13/181; G08B 29/02

[52] U.S. Cl. ..... 340/572.1; 340/501; 340/505; 340/541; 340/825.32; 340/825.34; 340/825.54

[58] Field of Search ..... 340/541, 501, 340/505, 540, 573.4, 572.1, 825.31, 825.32, 825.34, 825.54

[56] References Cited

U.S. PATENT DOCUMENTS

| | | | |
|---|---|---|---|
| 3,891,980 | 6/1975 | Lewis et al. | 340/825.31 |
| 5,363,448 | 11/1994 | Koopman, Jr. et al. | 340/825.31 |
| 5,377,270 | 12/1994 | Koopman, Jr. et al. | 340/825.31 |
| 5,657,388 | 8/1997 | Weiss | 340/825.31 |

*Primary Examiner*—Glen Swann

[57] ABSTRACT

An alarm system having motion violation sensors (motion or other presence detectors and door and window switches) can have a potential alarm condition be determined to not be a violation of the secured space in response to an authorization code transmitted by a personal device worn by a user. In one embodiment, the personal device transmits an authorization code periodically to bypass sensors in that room for an interval slightly longer than the period between transmissions. In another embodiment, a request for authorization is transmitted in response to a potential alarm condition, in response to which the device transmits the code. In one embodiment, a single authorization code is changed each time the alarm is disarmed, thereby to prevent recordation and subsequent use thereof. Another embodiment responds to plural authorization codes, such as ID numbers of authorized personnel.

17 Claims, 6 Drawing Sheets

DYNAMICALLY BYPASSED ALARM SYSTEM

TECHNICAL FIELD

This invention relates to alarm systems in secure space which include violation sensors, and in which receipt of a proper authorization code from a personal device to be worn by occupants of the secure space render the triggering of said sensors to be deemed not to be a violation of the space.

BACKGROUND ART

Typical household and commercial alarm systems employ numerous motion detectors as a way of ensuring that any intruder will be detected as he moves about, regardless of how the premises were entered and regardless of whether such entry occurred before the alarm was on (such as during normal business hours), or by cutting glass of an alarmed window, or the like. Such systems typically provide for the user to bypass portions of the alarm system, so that the perimeter portion of the alarm system can be on while authorized people are within the secure space, without setting off the alarm. However, in large houses, it sometimes becomes difficult to remember to change the bypass system if an authorized person is moving about. Thus, in a house having an all-glass walkout basement that is adjacent to a deep woods, it may be desired to leave the motion detectors armed, along with any sliding doors in the basement, while the middle floor of the house is occupied. However, should someone forget and enter the basement without altering the alarm system, the alarm system will be triggered and the person may have a difficult time reaching the control panel in time to avoid an automatic telephone call alert. It is known that numerous false alarms cause automatic alerts to be treated casually, and are therefore to be avoided.

Dogs, cats and other pets in the house preclude use of presence detectors in alarm systems; or, such detectors must be bypassed except when the pets leave (e.g., during vacation).

The use of "smart badges" which transmit ID numbers, for tracking the whereabouts of personnel in a facility, can be thwarted by simply taking the badge off.

SUMMARY OF INVENTION

Objects of the invention include provision of improved authorized use of a secure space while an alarm system is on, allowing authorized users to freely move throughout the alarmed space, providing significantly greater security than that which is available today for authorized persons while utilizing secured space with the alarm system on, use of motion detectors in a house with pets, and sensing presence of personnel who are not wearing smart badges.

According to the present invention, an alarm system includes one or more motion detectors dispersed in diverse parts of a secure space, each sensor having a receiver associated therewith, there being one or more portable devices to be worn by authorized users (which includes pets herein) within the secure space when the alarm system is on, receipt of an authorization code from one of the personal devices will negate treating the triggering of the motion detector as a violation of the secure space. The portable devices may be collars, bracelets, clip-ons, or otherwise.

In accordance with the invention in one form, each activation of a motion detector causes a corresponding transceiver to inquire, by an electromagnetic transmission, whether or not there is an authorized user in the space, the portable device of the authorized user responding to the electromagnetic transmission with an appropriate code, whereby a proper response will negate an alarm. In accordance with the invention in another form, periodic transmissions of an authorization code from a portable device cause any nearby motion detector to be bypassed for a period of time slightly longer than the period between transmissions of the code.

The transmission may be transmitted electromagnetically or acoustically.

In accordance further with the invention, a proper code may be entered into the portable device, periodically, by using the conventional personal identification number (PIN) at the control panel and operating a switch to cause the control panel to transmit a currently-proper code into the personal device, or the code may be entered by hand. In accordance with the invention still further, the code is changed each time the alarm is disarmed.

In further accord with the present invention in one form, in the event that a plurality of portable devices are to receive an authorization code, they will all receive the same code, whereby two or more persons can move freely in a secure space with the alarm fully armed.

In accordance with the invention further, the movement of personnel about a commercial or governmental facility can be monitored by having an alarm system with presence detectors on at all times, with each person carrying a badge which will transmit, either periodically or in response to a request from triggering a motion detector, the identification number of the person wearing the badge. The lack of response, or response by a badge assigned to a person not authorized to be in a space monitored by the presence detector, can be recognized as an alarm condition.

The invention provides significantly greater personal protection to individuals occupying a secure space since it permits free utilization of the space by authorized persons and pets, while retaining security against intruders.

Other objects, features and advantages of the present invention will become more apparent in the light of the following detailed description of exemplary embodiments thereof, as illustrated in the accompanying drawing.

DETAILED DESCRIPTION OF THE INVENTION

Figure 1:
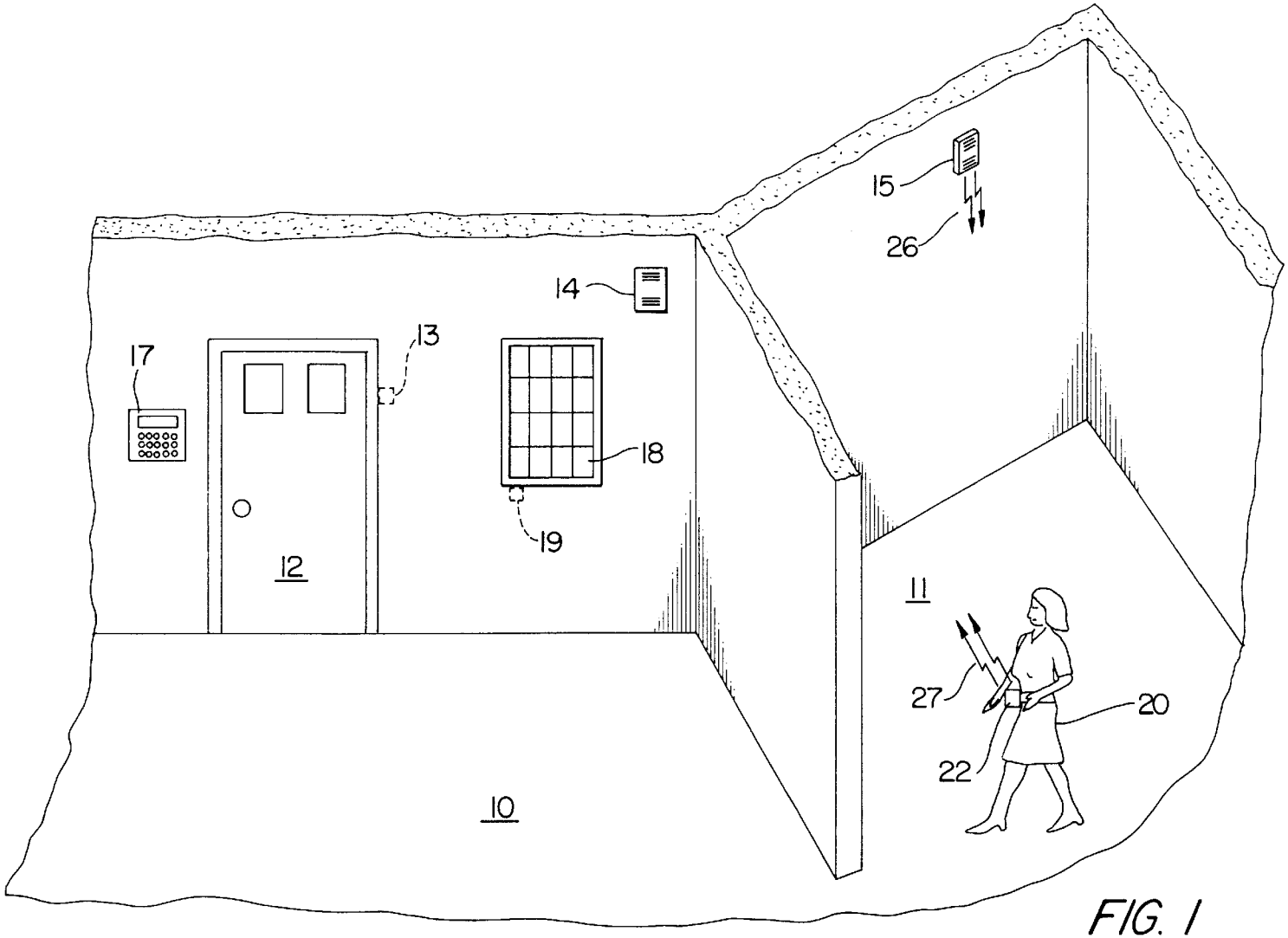
FIG. 1 is a partial, stylized perspective view of a pair of rooms in a house including an alarm system according to the present invention.

Referring now to FIG. 1, a portion of an alarm system in accordance with the present invention is shown as it may apply in two rooms 10, 11, in which an entrance door 12 may have an alarm switch 13, and each room may have a corresponding motion detector 14, 15. Near the entrance door 12 is a conventional control device 17. A window 18 may similarly be provided with a switch 19 to indicate when the window has been opened. In accordance with the invention, a person 20 who desires to use the secure space protected by the alarm system may wear a portable device 22 somewhere on her body. In operation, should the motion detector for instance, sense motion of the person 20, an interrogation by electromagnetic radiation or acoustic vibrations, as indicated by the arrows 26, will be received by the portable device 22, which in turn will respond with electromagnetic radiation or acoustic vibrations in like kind with the transmission of the motion detector 15, the transmission from the device 22 including a code to authenticate the authority of the user to be within the secure space while the alarm is on. Obviously, operation would be the same for a pet. Similarly, if the person 20 were to open the door 12, such as to get the morning paper, a transmitter within the control 17 (or one within the motion detector 14) will transmit an inquiry and receive an appropriate response, thereby not to recognize the door opening as a violation of the secure space. Every possible switch or other sensor which could enter an alarm condition may similarly be provided with a transceiver, if desired. However, it would appear to be economically more prudent simply to use one transceiver per room which will handle sensings of any and all sorts of detectors with respect to that room. The transceivers need not necessarily be individually associated with each sensor. For instance, a transceiver within the control panel 14 may do the inquiry for a potential alarm created by the switch 13 on the entry door 12 as well as for a potential alarm created by motion within the room 10. Suffice it to say that any potential alarm condition can be associated with a challenge for an authorization signal to cause the potential alarm condition to be deemed to not be a breach of the secure space.

To the extent necessary, the transmissions from the alarm units may be made sufficiently directional and low powered so as to not induce an inquiry in a device which is not either in the same room, or within an open space generally visible to the same room. While optical frequency, or near-optical frequency transmissions may be used, since such transmissions are easily blocked and will not turn corners, it is believed best that lower frequency electromagnetic radiation (such as any number of available of RF channels) or acoustics be used.

Figure 2:
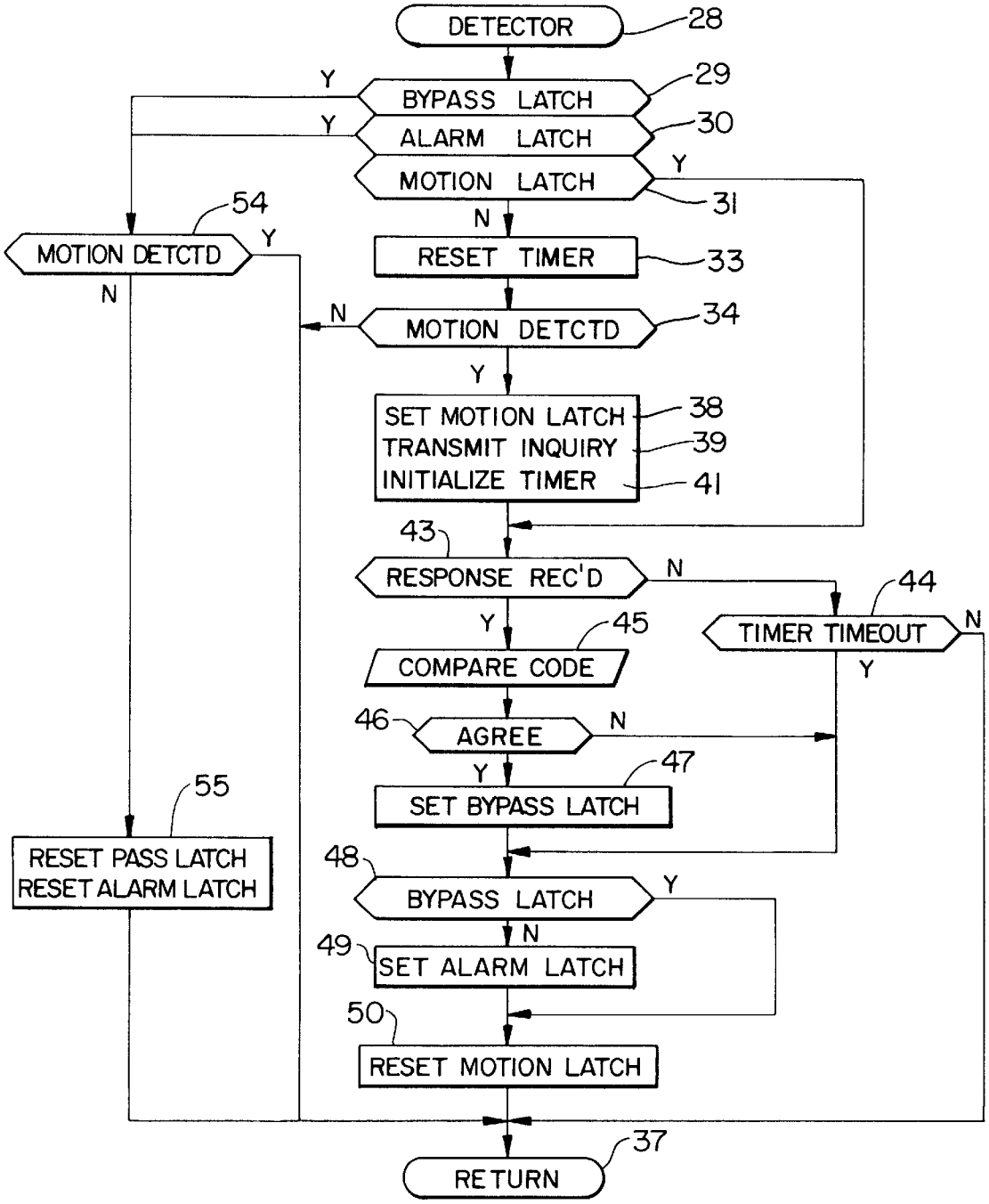
FIG. 2 is a high level functional diagram of operation of one form of a system in accordance with the present invention.

Referring now to FIG. 2, a detector routine which performs the function of the invention with respect to a corresponding sensor, is reached through an entry point 28 and a first set of tests 29–31 determines if a pass latch, an alarm latch or a motion latch (described hereinafter) has been set or not. Prior to sensing motion, all three latches will not have been set, so negative results of tests 29–31 will reach a step 33 to reset a timer, as described more fully hereinafter. Then a test 34 determines if the corresponding motion detector has detected motion. If not, a negative result of test 34 causes the remainder of the routine to be bypassed, and other programming to be reverted to through a return point 37. However, if motion has been detected, an affirmative result of test 34 will reach a step 38 to set the motion latch, so that future passes through the routine of FIG. 2 will not go through the step 33 or the test 34, as described hereinafter. Then, a step 39 causes an inquiry signal to be transmitted to determine if there is an authorized personal device within the proximity of the detector to which this routine relates. And, a step 41 initializes a timer to establish a period of time (perhaps a second or fraction thereof) within which an authorized response must be received.

A test 43 determines if a response has been received, and if not, a negative result reaches a test 44 to determine if the timer, initialized in step 41, has timed out or not. Initially, it may not, so a negative result of test 44 reaches the return point 37 to free-up the computer for other tasks. In the next pass through the routine of FIG. 2, tests 29 and 30 are still negative but test 31 is affirmative, returning the routine to test 43 to determine if a response has been received or not. If a response has been received, an affirmative result of test 43 reaches a subroutine 45 to compare the authorization code within the response to the predetermined authorization code most recently established in the alarm system in a manner described with respect to FIG. 3, hereinafter, or in any other suitable way. Then a test 46 determines if the two codes agree. If they do agree, an affirmative result of test 46 reaches a step 47 to set a bypass latch to indicate that this incidence of motion detection has responded to inquiry and has been authenticated. Following comparison of the codes in the subroutine 45, if the test 46 is negative because the proper code was not received, the step 47 is bypassed. Then a test 48 determines if the bypass latch has been set or not; if not, an alarm latch is set in a step 49; but if the bypass latch is set, an affirmative result of test 48 avoids setting the alarm latch. A step 50 will reset the motion latch so as to allow the previously described operation upon a subsequent incidence of motion being detected. Setting of the alarm latch in this routine is equivalent to the motion detector detecting motion in an alarm system which does not have the present invention. On the other hand, if no response is received prior to time-out of the timer, the test 44 will be affirmative reaching the test 48 and the step 49 to similarly set the alarm latch. In other words, if a wrong code is received or no code is received, the alarm latch will be set in the step 49. Thereafter, the step 50 will reset the motion latch to enable a future cycle of operation, and other programming is reverted to through the return point 37.

In any pass through the routine of FIG. 2 after either the bypass latch is set in step 47 or the alarm latch is set in step 49, either test 29 or test 30 will be affirmative reaching a test 54 to determine if motion is being detected, or not. In a type of system in which the motion detectors retain a potential alarm state for anywhere from a significant fraction of a second to several seconds, the test 54 will determine when that potential alarm state has ceased. The potential alarm state can of course be prolonged by continuous motion within the surveillance area of the detector for which the routine of FIG. 2 is being performed. In such a case, test 54 will remain negative until such motion ceases, and any extension of the indication has also ceased. So long as motion is detected, an affirmative result of test 54 causes other programming to be reached through the return point 37. This leaves either the bypass latch or the alarm latch set until such time as the motion detector is once again quiescent. Then, in a subsequent pass through the routine of FIG. 2, either test 29 or 30 still being affirmative, but test 54 now being negative, a pair of steps 55 will reset both the pass latch and the alarm latch (one of them being reset redundantly), to set up for subsequent operation.

Figure 2A:
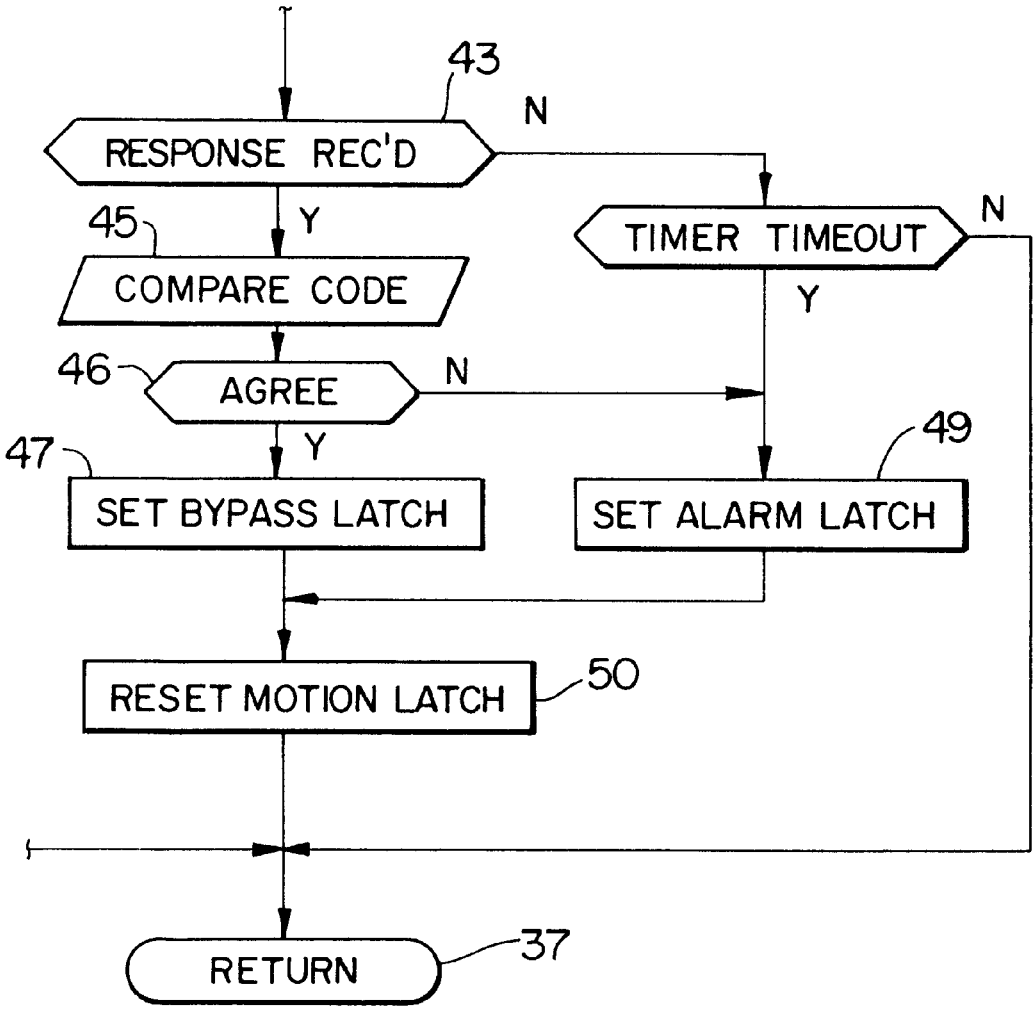
FIG. 2A is a partial diagram showing a minor variation in the diagram of FIG. 2.

Of course, routines other than that described with respect to FIG. 2 may be used. Particularly, the nature of routines used to provide the inquiry and make a decision as to whether the potential alarm condition is caused by an authorized person or pet or an intruder may take a variety of forms in dependence upon the specific detailed nature of the alarm system with which it is used. Therefore, the description of FIG. 2 should be taken simply as explanatory, and not as a necessary way of implementing the invention. As an example, FIG. 2A shows that the alarm latch can be set directly, eliminating the test 48. For power conservation, the portable device may comprise a conventional microcomputer having a quiescent mode in which its only function is to respond to an interrupt. Upon receipt of an inquiry by the device, the device will become fully operational, initialized and transmit the authorization code.

Figure 3:
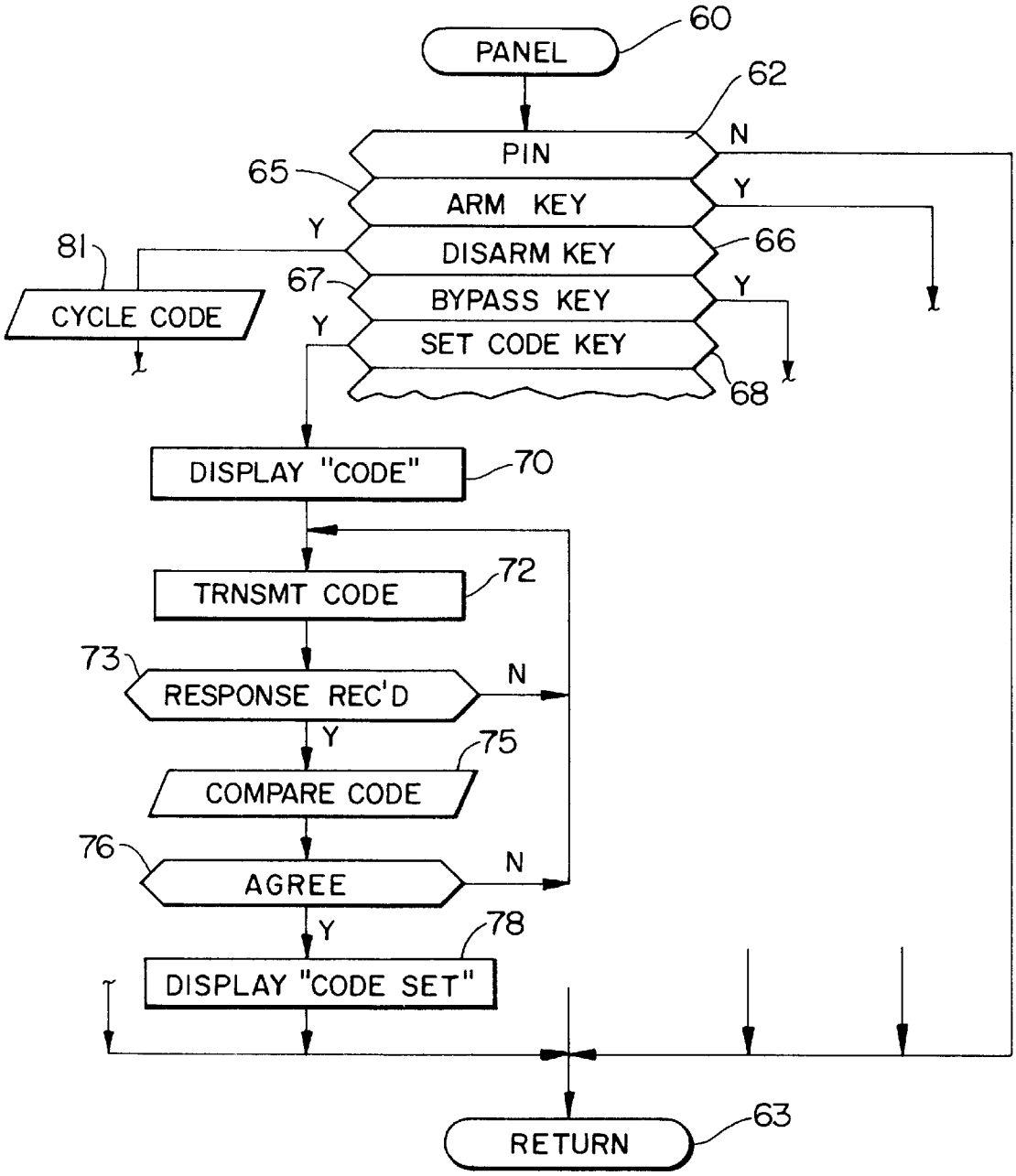
FIG. 3 is a high level functional diagram of entering a secure authorization code into a personal device to be worn by a user so as to selectively defeat the alarm system in accordance with the embodiment of FIG. 2.

In rooms with control panels, the transceiver should be in a control panel to assist in loading the code into the personal device. Referring to FIG. 3, a panel routine is entered through an entry point 60, and a first test 62 determines if the conventional personal identification number has been entered or not. If not, other programming is reached through a return point 63. On the other hand, if a personal identification number has been entered, an affirmative result of test 62 will reach a series of tests 65–68 to determine if the user has pressed the conventional arm key, disarm key, bypass key, and so forth, or the set code key in accordance with the invention. To put a fresh code into the personal device 22, the user will approach the control panel 17, turn the personal device on, enter the personal identification number, and press the set code key. In a subsequent pass through the routine of FIG. 3, an affirmative result of test 68 will reach a step 70 to cause the panel 17 to display the word "code". The next step 72 will cause the new code to be transmitted from the panel 17 so it can be received in the personal device 22. The panel then waits until it receives a response from the personal device 22, which is the same response used to authenticate presence in a room. A test 73 determines if the response has been received and causes the code to continuously be transmitted until the response is received. Then a subroutine 75 compares the codes and a test 76 determines if the codes agree. If not, a negative result of test 76 causes the step 72 to transmit the code and the process is repeated. Eventually, the correct code is received so an affirmative result of test 76 reaches a step 78 to display the phrase "code set", and other programming is reached through the return point 63. Any one or more of the personal devices 22 (on people and pets) which were in the room with the control panel 17, with its power switch turned on, as the panel routine of FIG. 3 is performed, will have the correct code set in it and therefore allow the persons bearing the devices 22 to move freely throughout the building.

The system should be set up so that the personal device 22 can be provided with the proper code, after which the alarm system is turned on. Therefore, the authorization code, which may be a near-random code shown in U.S. Pat. Nos. 5,363,448 and 5,377,270, should preferably be cycled each time that the alarm system is disarmed, thereby ensuring that any use of a personal receiver will be with a new code which is different from the code (if any) used in any prior arming of the alarm. Security is enhanced because the code is not initially transmitted into a device until the personal identification number is entered into the keyboard at the panel 17. In FIG. 3, in each pass through the panel routine, whenever the disarm key is pressed, an affirmative result of test 66 will reach a subroutine 81 to cycle the code before performing the other, conventional functions required in disarming the alarm.

The invention may also be used in commercial or governmental facilities which requires tracking of individuals and assurance that unauthorized entry of particular portions of the space will be detected. Instead of using a changing cryptographic code, authorized personnel will carry a badge which will respond by transmitting the badge-wearer's identification number. Then, the computer must search among the authorized identification numbers for that particular space, or search the authorized identification numbers to determine if the identification number in question has a tag indicating authority to be within the particular space of the potential alarm. Stated more simply, the authorization code may be one of many predetermined codes such as ID numbers. In addition, if desired, each badge could also receive a cryptographic code upon entry of the building, concomitant with visual recognition of the employee, or the like. In such a system, the presence detector portions of the alarm system will be on all the time, and each triggering of a presence detector will cause an inquiry to determine if the person who set it off has a badge capable of responding with an identity number, and whether that identity number matches those that are permitted access to the particular space monitored by the presence detector. Where the authorization code is simply the ID number of the person carrying the badge, the badge may simply have a passive RFID, the operating beacon of which is triggered in response to the detection of presence.

Figure 4:
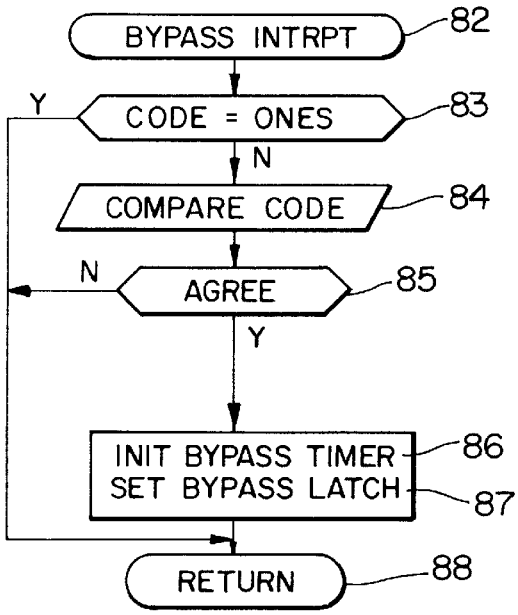
FIG. 4 is a functional diagram of a bypass interrupt of a second form of the present invention.

Another embodiment of the invention is much simpler, using regular transmissions from the devices to cause interrupts in the building portion of the system which control the selective, dynamic bypassing of portions of the system. Each presence detector will have a corresponding set of interrupts of the sort illustrated in FIG. 4 and FIG. 5. The bypass interrupt of FIG. 4 is caused by each repetitive transmission from a personal device 22, which simply transmits the authorization code every so many seconds. In FIG. 4, a bypass interrupt routine is reached through an interrupt entry point 82 and a first test 83 determines if the predetermined code in the panel is all ones; if so, the rest of the routine is avoided, and dynamic bypass cannot be used, as described hereinafter. But if the predetermined code is other than all ones, it is compared with the authorization code which caused the interrupt, in a subroutine 84. Then, if they agree, test 85, a pair of steps 86, 87 initiate a bypass timer and set a bypass latch, after which other programming is reached through a return point 88. But if the codes do not agree, the steps 86 and 87 are bypassed. In this embodiment, the device 22 may transmit on the order of every 5 to 20 seconds, depending upon the tightness of security, the length of battery life, and so forth, desired in any implementation of the present invention. As a result, any violation sensors, such as a motion detector or door switch, in the corresponding immediate vicinity, will be bypassed for a length of time which is somewhat longer than the time interval between transmissions, as determined by the bypass timer. This ensures that so long as the personal device 22 is sending the proper code, periodically, the violation sensors in the vicinity of the device 22 will be bypassed.

Figure 5:
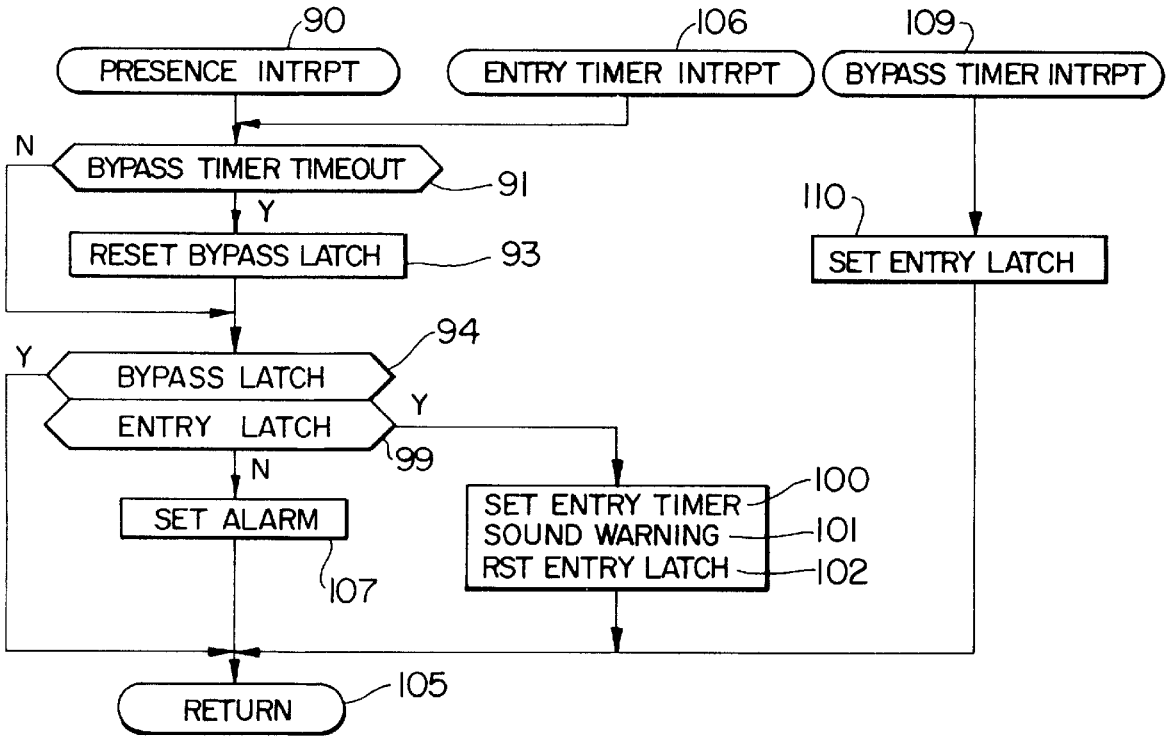
FIG. 5 is a functional diagram of a presence interrupt routine of the form of the invention in FIG. 4.

In FIG. 5, a presence interrupt is caused by a corresponding presence detector sensing someone in the space. An entry latch prevents an alarm condition from occurring as a user first enters a room, before the first code transmission from the portable device is received at the corresponding sensor. The motion interrupt routine is reached through an interrupt entry point 90 and a first test 91 determines if the bypass timer has timed out or not. If it has, an affirmative result reaches a step 93 which resets the bypass latch which was set in step 87 of FIG. 4. But if the timer has not timed out, step 93 is bypassed. Then a test 94 determines if the bypass latch is set, or not. If the bypass latch is not set, then this portion of the alarm system is not bypassed, so the motion which caused the interrupt may result in an alarm. A negative result of test 94 reaches a test 99 to see if the entry latch is still set. If it is, that means this is the first alerting by this sensor and it could be an authorized person or pet entering a room. An affirmative result of test 99 reaches a step 100 which initiates an entry timer, a step 101 which sounds a warning (similar to that used when entering a fully alarmed home), and a step 102 which resets the entry latch. Then, the program reverts through return point 105.

At this point, the response of the system to the alerting of a presence detector awaits the time out of the entry timer. The entry timer will have a time interval that is somewhat longer than the interval between transmission of authorization codes by the portable devices, so as to assure that the system will receive a transmission from an authorized user (if appropriate) between the time of a presence interrupt and the time out of the entry timer. When the entry timer times out, it causes an entry timer interrupt which reaches the routine of FIG. 5 through an entry point 106. The operation of FIG. 5 is the same, except it is caused at a fixed time remotely from the presence interrupt. If by now the bypass timer is not timed out, this means that an authorized user has entered the room and initiated it. The bypass latch will have been set once again (FIG. 4) and the step 93 of FIG. 5 is not performed due to a negative result of test 91. This results in test 94 being positive so that other programming is reverted to through the return point 105, without setting the alarm. On the other hand, when the entry timer times out, if the bypass timer has also timed out, test 91 will be affirmative resetting the bypass latch in step 93. Thus, step 94 will once again be negative, but this time the entry latch will be reset so step 99 is affirmative causing the alarm to be set in step 107.

Setting the alarm in step 107 is equivalent to the alarm condition which a presence detector will cause in a system not utilizing the present invention. When an authorized user finally leaves the room, eventually the bypass timer will time out, causing a bypass timer interrupt reaching the routine of FIG. 5 through an entry point 109.

All this does is set the entry latch in a step 110 so that any further sensing of presence in that particular space will cause the entry delay to allow time for an authorized code to be received.

In any system which utilizes a warning sound and a delay in entering an alarm, as is typical at entry doors of conventional systems, then the present invention may be practiced by allowing the arming condition to go into effect, during which time if there is an authorized user, it will deactivate the alert condition causing the warning sound to cease and cancelling the alarm. If desired, the bypass latch need not be used at all, the bypass timer simply being initiated in FIG. 4 and tested in the position of test 94 in FIG. 5. The use of the bypass latch simply ensures the lack of a glitch; that is, it provides synchronizing of the bypass event to the routine of FIG. 5. The step 107 is equivalent to sensing motion in an alarm system which does not practice the present invention. On the other hand, so long as the bypass latch is set, an affirmative result of test 94 bypasses the step 107 and allows other programming to be reached through a return point 105. In the embodiment of FIGS. 4 and 5, the building-mounted alarm devices do not have transmitters, since they only receive the periodically transmitted codes from the personal devices. Similarly, the personal devices need not have any receivers. Thus, the system is much simpler.

Figure 6:
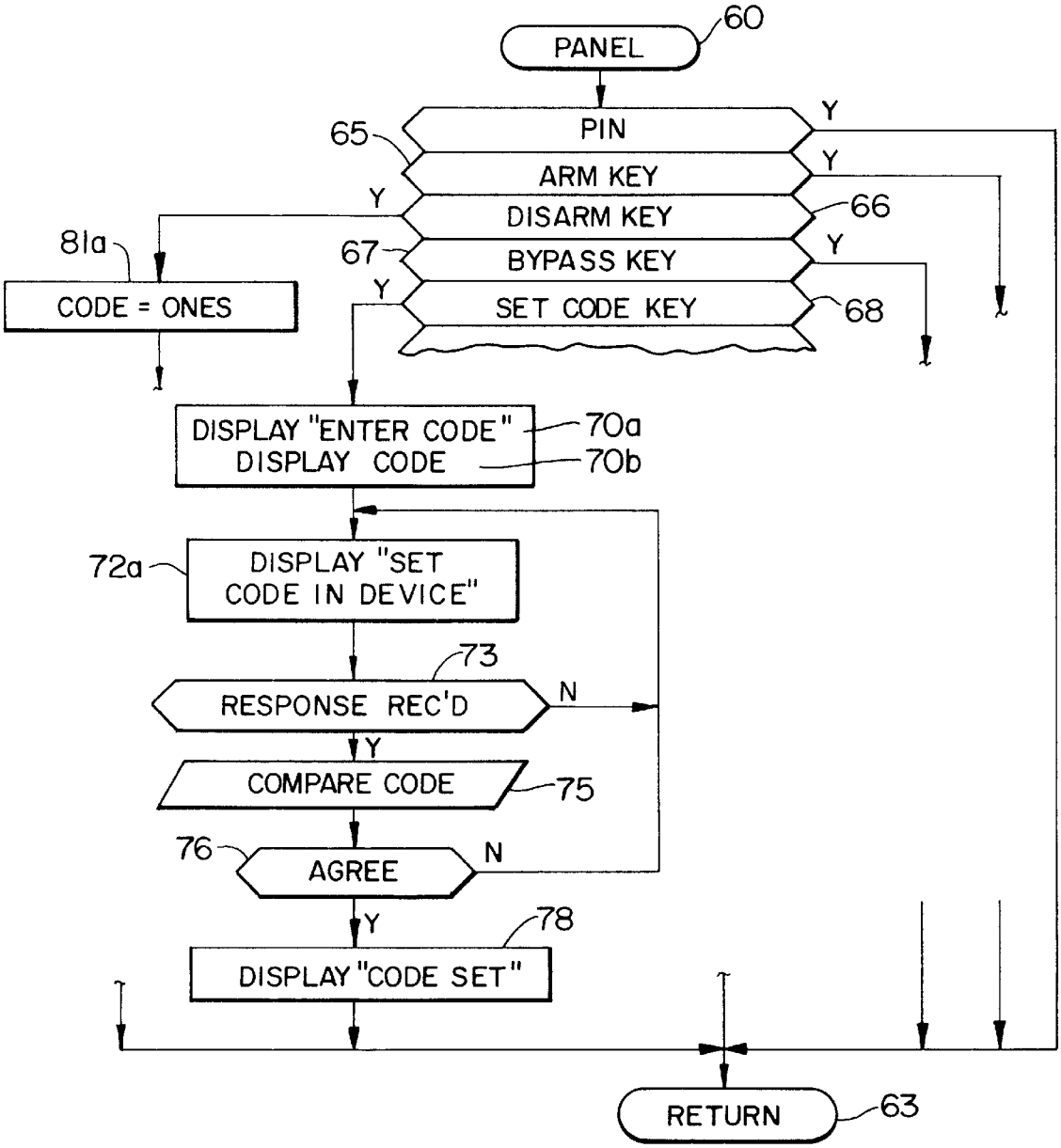
FIG. 6 is a functional diagram of entering an authorization code by hand.

In order to provide the code into the simple system of FIGS. 4 and 5, a receiver may be provided in the device 22, and the routine of FIG. 3 utilized; or, the code may be transmitted by wire, utilizing a jumper cable to connect the personal device 22 with a control panel. Or, randomly selected codes may be entered on numerical buttons provided on the personal device 22 as well as on the control panel. Referring to FIG. 6, in such a case, the panel routine reached through the entry point 60 may have a step 81*a* in place of the subroutine 81 of FIG. 3, which simply sets the code to all ones. The simple device 22, when first turned on, will reset the authorization code to all zeroes. Thus, there can be no authentication until a pair of matching codes are entered. The test 73 may be eliminated if desired, except in a case where the device 22 may initialize the code as all ones. This resetting prevents dynamic bypass from being used, as described hereinbefore with respect to FIG. 4, until new codes are set. When dynamic bypass is to be used, pressing of the set code key will cause an affirmative result of test 68 reaching a step 70*a* to cause "ENTER CODE" to be displayed on the panel, after which a step 70*b* will cause the code to be displayed, as it is entered. Then a step 72*a* will cause "SET CODE IN DEVICE" to be displayed on the panel, so that the same code will be entered into the device by the user. In this embodiment, once the code is in the device, it will be transmitted periodically, automatically. Thus, eventually, it will be received in the panel so it can be compared, and so forth. When the response is received as indicated by step 73, and a subroutine 75 compares the code and a step 76 determines that they agree, the step 78 will cause "CODE SET" to be displayed on the panel in the same fashion as in FIG. 3. The code entered by the user can be any number which the user desires, and may be any reasonable number of numerals (e.g., 6–20 numerals). This method of establishing the code may be used in the embodiment of FIGS. 2 and 3, if desired.

The simple embodiment of the invention just described may also be used in commercial or governmental facilities; in such case, each badge will periodically transmit its code (ID number) so that any motion detector in the immediate vicinity of such a person, who is authorized to be in the space, will go into a bypass mode for a period of time which is greater than the transmission interval of the badges.

The dynamic bypass signals, herein created by setting a dynamic bypass latch, may in fact be integrated with the keyinduced, conventional zone bypass in any system, the invention simply providing a dynamic way of creating such a bypass in response to a personal device.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An alarm system comprising:

one or more motion detectors for providing a violation signal indicative of a potential alarm in response to sensing motion within a space;

a transmitter for transmitting, in response to said violation signal, an inquiry message within said space;

a portable device including a transmitter and a receiver for receiving said inquiry message and, in response thereto, transmitting said authorization code;

signal processing means for comparing said authorization code with one or more predetermined codes, and, if said authorization code is identical with one said predetermined code, providing a dynamic bypass signal, said signal processing means responsive to said violation signal for causing an alarm indication signal in response to the presence of said violation signal concurrently with the absence of said dynamic bypass signal, but not providing said alarm indication signal in response to the presence of said violation signal concurrently with said dynamic bypass signal; and a control panel having keys for entering a personal identification number and selecting a function, one function being setting said predetermined code into said portable device for transmission thereafter as said authorization code; and wherein said signal processing means comprises means responsive to said code setting function for transmitting said predetermined code; and said portable device, in response to receipt of said predetermined code, sets said authorization code equal to said predetermined code.

2. An alarm system according to claim 1 wherein said portable device, in response to receipt of said predetermined code, sets said authorization code equal to said predetermined code and transmits said authorization code; and said signal processing means comprises means for comparing said predetermined code with said authorization code sent in response to receipt of said predetermined code and providing an indication that the code is set when the two codes agree.

3. An alarm system according to claim 1 wherein said signal processing means comprises means for comparing said authorization code with a plurality of predetermined codes.

4. An alarm system according to claim 3 wherein said predetermined codes are respective identification numbers of persons authorized to be in the space corresponding to said violation sensor.

5. An alarm system comprising:

one or more motion detectors for providing a violation signal indicative of a potential alarm in response to sensing motion within a space;

a portable device including a transmitter for transmitting an authorization code; and signal processing means for comparing said authorization code with one or more predetermined codes, at least one said predetermined code being changed each time that said alarm is disarmed, and, if said authorization code is identical with one said predetermined code, providing a dynamic bypass signal, said signal processing means responsive to said violation signal for causing an alarm indication signal in response to the presence of said violation signal concurrently with the absence of said dynamic bypass signal, but not providing said alarm indication signal in response to the presence of said violation signal concurrently with said dynamic bypass signal.

6. An alarm system according to claim 5 wherein said signal processing means comprises means for comparing said authorization code with a plurality of predetermined codes.

7. An alarm system according to claim 6 wherein said predetermined codes are respective identification numbers of persons authorized to be in the space corresponding to said violation sensor.

8. An alarm system comprising:

one or more motion detectors for providing a violation signal indicative of a potential alarm in response to sensing motion within a space;

a portable device including a transmitter for transmitting an authorization code on a periodic basis; and signal processing means for comparing said authorization code with one or more predetermined codes, and, if said authorization code is identical with one said predetermined code, providing a dynamic bypass signal, in response to each receipt of said authorization code that is identical with said predetermined code, for a period of time which is just slightly in excess of the period between successive transmissions of said authorization code, said signal processing means responsive to said violation signal for causing an alarm indication signal in response to the presence of said violation signal concurrently with the absence of said dynamic bypass signal, but not providing said alarm indication signal in response to the presence of said violation signal concurrently with said dynamic bypass signal.

9. An alarm system according to claim 8, further comprising:

a control panel having keys for entering a personal identification number and selecting a function, one function being setting said predetermined code into said alarm system by means of said keys; and for assisting in and verification of setting the same code into said personal device for transmission thereafter as said authorization code; and said signal processing means comprising means for providing prompt displays to the panel user to assist in entering the same code into said panel and into said personal device, and for providing an indication that the code is set when the first periodic transmission of said authorization code agrees with said predetermined code.

10. An alarm system according to claim 9 wherein:

said signal processing means comprises means for setting said predetermined code to a specific value each time said alarm system is disarmed and, in response to said specific value, prevents the reception of said authorization code from providing said bypass signal, whereby a new predetermined code must be established for each arming of the alarm in order to utilize selective bypass.

11. An alarm system according to claim 10 wherein:

said signal processing means comprises means for setting said predetermined code to a first specific value each time said alarm system is disarmed, and said authorization code in said device is initialized, each time said device is turned on, to a second specific value which is different than said first specific value.

12. A method of dynamically bypassing portions of a security alarm system in a secured space having one or more motion detectors, comprising:

providing an authorized user of the secured space with a device to be borne by the user, said device transmitting an authorization code periodically;

comparing said authorization code with one or more predetermined codes; and if said authorization code is identical with one said predetermined code, bypassing at least one said motion detector in the vicinity of said device for a short period of time which is slightly in excess of the period of time between transmissions of said authorization code.

13. A method according to claim 12 wherein said authorization code is compared with a plurality of predetermined codes.

14. A method according to claim 12 wherein said predetermined codes are respective identification numbers of persons authorized to be in the space corresponding to said violation sensor.

15. A method of dynamically bypassing portions of a security alarm system in a secured space having one or more motion detectors, said alarm system having a control panel with keys for numerical entry and for function selection, comprising:

providing an authorized user of the secured space with a device to be borne by the user, said device transmitting an authorization code;

entering one or more predetermined codes into said control panel with said keys of said panel;

comparing said authorization code with said one or more predetermined codes; and if said authorization code is identical with one said predetermined code, bypassing at least one said motion detector in the vicinity of said device for at least a short period of time.

16. A method of dynamically bypassing portions of a security alarm system in a secured space having one or more motion detectors, comprising:

providing an authorized user of the secured space with a device to be borne by the user, said device having keys for numerical entry, entering an authorization code into said device with said keys of said device, said device transmitting said authorization code;

comparing said authorization code with one or more predetermined codes; and if said authorization code is identical with one said predetermined code, bypassing at least one said motion detector in the vicinity of said device for at least a short period of time.

17. A method of dynamically bypassing portions of a security alarm system in a secured space having one or more motion detectors, comprising:

providing an authorized user of the secured space with a device to be borne by the user, said device transmitting an authorization code;

comparing said authorization code with one or more predetermined codes, at least one said predetermined code being changed each time that said alarm system is disarmed, and if said authorization code is identical with one said predetermined code, bypassing at least one said motion detector in the vicinity of said device for at least a short period of time.

* * * * *